United States Patent [19]

Chia et al.

[11] 4,192,693

[45] Mar. 11, 1980

[54] ALUMINUM COPPER ALLOY ELECTRICAL CONDUCTOR AND METHOD

[75] Inventors: E. Henry Chia; Roger J. Schoerner, both of Carrollton, Ga.

[73] Assignee: Southwire Company, Carrollton, Ga.

[21] Appl. No.: 825,639

[22] Filed: Aug. 18, 1977

Related U.S. Application Data

[63] Continuation-in-part of Ser. No. 724,687, Sep. 20, 1976, which is a continuation-in-part of Ser. No. 685,469, May 12, 1976, which is a continuation-in-part of Ser. No. 505,821, Sep. 13, 1974, abandoned, which is a continuation of Ser. No. 194,757, Nov. 1, 1971, abandoned.

[51] Int. Cl.[2] ..... C22F 1/04

[52] U.S. Cl. ..... 148/2; 75/139; 148/11.5 A; 148/32

[58] Field of Search ..... 148/2, 11.5 A, 32, 32.5; 75/138, 139

[56] References Cited

U.S. PATENT DOCUMENTS

| | | | |
|---|---|---|---|
| 3,512,221 | 5/1970 | Schoerner | 75/138 |
| 3,663,216 | 5/1972 | Hunsicker | 148/11.5 A |
| 3,763,686 | 10/1973 | Besel et al. | 148/11.5 A |
| 3,770,515 | 11/1973 | Besel | 148/11.5 A |

*Primary Examiner*—R. Dean

*Attorney, Agent, or Firm*—Herbert M. Hanegan; Stanley L. Tate; Robert S. Linne

[57] ABSTRACT

An aluminum alloy electrical conductor having an electrical conductivity of at least fifty-seven percent (57%) based on the International Annealed Copper Standard and unexpected properties of increased bendability, creep resistance, fatigue resistance and thermal stability at a minimum standard elongation, when compared to conventional aluminum alloy conductors of the same tensile strength is described. The aluminum alloy conductors are produced by the addition of from about 0.10 weight percent to about 1.00 weight percent copper and up to about 0.10 weight percent iron to an alloy mass containing from about 98.70 weight percent to about 99.90 weight percent aluminum, and trace quantities of conventional impurities normally found within a commercial aluminum alloy.

7 Claims, No Drawings

ALUMINUM COPPER ALLOY ELECTRICAL CONDUCTOR AND METHOD

CROSS REFERENCE TO RELATED APPLICATIONS

This application is a continuation-in-part of copending application Ser. No. 724,687, filed Sept. 20, 1976 which in turn is a continuation-in-part of copending application Ser. No. 685,469, filed May 12, 1976 which in turn is a continuation-in-part of Ser. No. 505,821, filed Sept. 13, 1974, now abandoned, which in turn is a continuation of Ser. No. 194,757, filed Nov. 1, 1971, now abandoned.

DESCRIPTION OF THE PREFERRED EMBODIMENTS

This invention relates to a method of preparing an aluminum alloy electrical conductor and more particularly concerns a method of preparing aluminum alloy conductor having an acceptable electrical conductivity, bendability, tensile strength and improved thermal stability and creep resistance at a standard minimum ultimate elongation.

The use of various aluminum alloy conductors (conventionally referred to as EC conductor, wire, rod, cable, bus bar, tube, connector, receptacle plug, etc.) as conductors of electricity is well established in the art. Such alloys characteristically have conductivities of at least fifty-seven percent of the International Annealed Copper Standard (hereinafter sometimes referred to as IACS) and chemical constituents consisting of substantial amount of pure aluminum and small amounts of conventional impurities such as silicon, vanadium, iron, copper, manganese, magnesium, zinc, boron and titanium. The physical properties of prior aluminum alloy conductors have proven less than desirable in many applications. Generally desirable percent elongations have been obtained only at less than desirable tnesile strengths and desirable tensile strengths have been obtainable only at less than desirable percent elongations. In addition, the bendability, fatigue resistance and creep resistance of prior aluminum alloy conductors has been so low that they have been generally unsuitable for many otherwise desirable applications.

Thus it becomes apparent that a need has arisen within the Industry for an aluminum alloy electrical conductor which has both improved percent elongation and improved tensile strength, and also possesses an ability to withstand numerous bends at one point and to resist fatiguing during use. Therefore, it is an object of the present invention to provide an aluminum alloy which after proper processing can be fabricated into an electrical conductor having acceptable conductivity and improved physical properties such that the conductor will meet new revised standards for circuit size aluminum conductors.

Another object of the present invention is to provide a method of processing an aluminum alloy whereby electrical conductors fabricated therefrom attain a standard minimum ultimate elongation, improved tensile strength, improved bendability, improved creep resistance and fatigue resistance, acceptable electrical conductivity and improved thermal stability.

These and other objects, features and advantages of the present invention will become apparent to those skilled in the art from a consideration of the following detailed description of the invention.

In accordance with this invention, the present aluminum alloy electrical conductor is prepared from an alloy comprising from about 98.70 weight percent to about 99.90 weight percent aluminum and from about 0.10 weight percent to about 1.00 weight percent copper. Preferably, the aluminum content of the present alloy comprises from about 99.25 to about 99.85 weight percent, with particularly superior results being achieved when from about 99.40 to about 99.80 weight percent aluminum is employed. Preferably the copper content of the present alloy comprises from about 0.15 weight percent to about 0.45 weight percent, with particularly superior results being achieved when from about 0.20 weight percent to about 0.30 weight percent copper is employed. It has been found that properly processed wire having aluminum alloy constituents which fall within the above-referenced ranges possesses acceptable electrical conductivity and improved tensile strength, a standard minimum ultimate elongation and in addition has novel unexpected properties of surprisingly increased bendability, fatigue resistance and thermal stability.

The present aluminum alloy is prepared by initially melting and alloying aluminum with the necessary amounts of copper or other constituents to provide the requisite alloy for processing. Typical impurities or trace elements are also present within the melt, but only in trace quantities such as not more than about 0.10 weight percent each with a total content of trace impurities generally not exceeding about 0.30 weight percent. Of course, when adjusting the amounts of trace elements due consideration must be given to the conductivity of the final alloy since some trace elements affect conductivity more severely than others. Typical trace elements include vanadium, iron, silicon, manganese, magnesium, zinc, boron and titanium.

Copper is the major constituent added to the melt to provide the alloy of the present invention. Normally, from about 0.30 to about 0.85 weight percent is added to the typical aluminum component used to prepare the present alloy. Of course, the sceop fo the present invention includes the addition of more or less copper together with the adjustment of the content of all alloying constituents.

After alloying, the melted aluminum composition is continuously cast into a continuous bar. The bar is then hot-worked in substantially that condition in which it is received from the casting machine. A typical hot-working operation comprises rolling the bar in a rolling mill substantially immediately after being cast into a bar.

One example of a continuous casting and rolling operation capable of producing continuous rod as specified in this application is contained in the following paragraphs.

CONTINUOUS CASTING AND ROLLING OPERATION

A continuous casting and rolling operation capable of producing continuous rod as specified in this application is as follows:

A continuous casting machine serves as a means for solidifying the molten aluminum alloy metal to provide a cast bar that is conveyed in substantially the condition in which it solidified from the continuous casting machine to the rolling mill, which serves as a means for hot-forming the cast bar into rod or another hot-formed product in a manner which imparts substantial movement to the cast bar along a plurality of angularly disposed axes.

The continuous casting machine of this embodiment is of conventional casting wheel type having a casting wheel with a casting groove partially closed by an endless belt supported by the casting wheel and an idler pulley, however continuous casting machines of the twin belt type may be used provided such machines are equipped with cooling means suitable for maintaining the temperature of the cast bar within the range hereinafter set out. The casting wheel and the endless belt cooperate to provide a mold into one end of which molten metal is poured to solidify and from the other end of which the cast bar is emmitted in substantially that condition in which it solidified.

The rolling mill is of conventional type having a plurality of roll stands arranged to hot-form the cast bar by a series of deformations. The continuous casting machine and the rolling mill are positioned relative to each other so that the cast bar enters the rolling mill substantially immediately after solidification and in substantially that condition in which it solidified. In this condition, the cast bar is at a hot-forming temperature within the range of temperatures for hot-forming the cast bar at the initiation of hot-forming without heating between the casting machine and the rolling mill. In the event that it is desired to closely control the hot-forming temperature of the cast bar within the conventional range of hot-forming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced positions about the axis of movement of the cast bar through the rolling mill. The rolls of each roll stand of the rolling mill are rotated at a predetermined speed by a power means such as one or more electric motors and the casting wheel is rotated at a speed generally determined by its operating characteristics. The rolling mill serves to hot-form the cast bar into a rod of a cross-sectional area substantially less than that of the cast bar as it enters the rolling mill.

The peripheral surfaces of the rolls adjacent roll stands in the rolling mill change in configuration; that is, the cast bar is engaged by the rolls of successive roll stands with surfaces of varying configuration, and from different directions. This varying surface engagement of the cast bar in the roll stands functions to knead or shape the metal in the cast bar in such a manner that it is worked at each roll stand and also to simultaneously reduce and change the cross-sectional area of the cast bar into that of a rod.

As each roll stand engages the cast bar, it is desirable that the cast bar be received with sufficient volume per unit for time at the roll stand for the cast bar to generally fill the space defined by the rolls of the roll stand so that the rolls will be effective to work the metal in the cast bar. However, it is also desirable that the space defined by the rolls of each roll stand not be overfilled so that the cast bar will not be forced into the gaps between the rolls. Thus, it is desirable that the rod be fed toward each roll stand at a volume per unit of time which is sufficient to fill, but not overfill, the space defined by the rolls of the roll stand.

As the cast bar is received from the continuous casting machine, it usually has one large flat surface corresponding to the surface of the endless band and inwardly tapered side surfaces corresponding to the shape of the groove in the casting wheel. As the cast bar is compressed by the rolls of the roll stands, the cast bar is deformed so that it generally takes the cross-sectinoal shape defined by the adjacent peripheries of the rolls of each roll stand.

Thus it will be understood that with this apparatus, cast aluminum alloy rod of an infinite number of different lengths is prepared by simultaneous casting of the molten aluminum alloy hot-forming or rolling the cast aluminum bar. The continuous rod as a minimum electrical conductivity of 57 percent IACS and may be used in conducting electricity or may be drawn to a wire of a small cross-sectional diameter.

To produce wire of various gauges, the continuous rod produced by the casting and rolling operation can then be processed in a reduction operation designed to produce continuous wire of various gauges. The unannealed rod (i.e., as rolled to f temper) is colddrawn through a series of progressively constricted dies, without intermediate anneals, to form a continuous wire of desired diameter. It has been found that the elimination of intermediate anneals is preferable during the processing of the rod and improves the physical properties of the wire. The conductivity of the hard drawn wire is at least 57 percent IACS. If greater conductivity or increased elongation is desired, the wire may be annealed or partially annealed after the desired wire size is obtained and cooled. Fully annealed wire has a conductivity of at least 58 percent IACS. At the conclusion of the annealing operation, it is found that the annealed alloy wire has the properties of acceptable conductivity and improved tensile strength together with unexpectedly improved percent ultimate elongation and surprisingly increased bendability and fatigue resistance as specified previously in this application. The annealing operation may be continuous as in resistance annealing, induction annealing, convection annealing by continuous furnaces or radiation annealing by continuous furnaces, or, preferably, may be batch annealed in a batch furnace. When continuously annealing, temperatures of about 450° F. to about 1200° F. may be employed with annealing times of about five minutes to about 1/10,000 of a minute. Generally, however, continuous annealing temperatures and times may be adjusted to meet the requirements of the particular overall processing operation so long as the desired tensile strength is achieved. In a batch annealing operation, a temperature of approximately 400° F. to about 750° F. is employed with residence times of about thirty (30) minutes to about twenty-four (24) hours. As mentioned with respect to continuous annealing, in batch annealing the times and temperatures may be varied to suit for the overall process so long as the desired tensile strength is obtained.

By way of example, it has been found that the following tensile strengths in the present aluminum wire are achieved with the listed batch annealing temperatures and times.

TABLE I

| Tensile Strength | Temperature (°F.) | Time (hrs.) |
|---|---|---|
| 12,000–14,000 | 650 | 3 |
| 14,000–15,000 | 550 | 3 |

TABLE I-continued

| Tensile Strength | Temperature (°F.) | Time (hrs.) |
|---|---|---|
| 15,000–17,000 | 520 | 3 |
| 17,000–22,000 | 480 | 3 |

A typical alloy No. 12 AWG wire of the present invention has physical properties of 15,000 p.s.i. tensile strength, ultimate elongation of 20%, conductivity of 58% IACS, and bendability of 20 bends to break. Ranges of physical properties generally provided by No. 12 AWG wire prepared from the present alloy include tensile strengths of about 12,000 to 22,000 p.s.i, ultimate elongations of about 40% to about 5%, conductivities of about 57% to about 61% and number of bends to break of about 45 to 10.

A more complete understanding of the invention will be obtained from the following examples.

EXAMPLE NO. 1

Various melts were prepared by adding the required amount of copper to 1816 grams of molten aluminum, containing less than 0.30% trace element impurities, to achieve a percentage concentration of elements as shown in the accompanying table; the remainder being aluminum. Graphite crucibles were used except in those cases where the alloying elements were known carbide formers, in which cases aluminum oxide crucibles were used. The melts were held for sufficient times and at sufficient temperatures to allow complete solubility of the alloying elements with the base aluminum. An argon atmosphere was provided over the melt to prevent oxidation. Each melt was continuously cast on a continuous casting machine and immediately hot-rolled through a rolling mill to ⅜ inch continuous rod. Wire was then drawn and annealed from the rod (soft [annealed] wire from hard [rolled] rod). The final wire diameter obtained was 0.1019 inches, 10 gauge AWG.

The types of alloys employed and the results of the tests performed thereon are as follows:

TABLE II

| CU | TOTAL TRACE ELEMENTS | UTS | % ELONG. | % IACS |
|---|---|---|---|---|
| .10 | 0.11 | 17,500 | 12.5 | 60.75 |
| 0.40 | 0.19 | 18,300 | 22.6 | 59.95 |
| 0.70 | 0.16 | 17,900 | 24.8 | 58.60 |
| 1.00 | 0.23 | 23,100 | 20.6 | 57.52 |

% Elong. = Percent ultimate elongation
UTS = Ultimate Tensile Strength
% IACS = Conductivity in Percentage IACS

EXAMPLE NO. 2

An additional alloy melt was prepared according to Example No. 1 so that the composition was as follows in weight percent:

Copper—0.30
Iron—0.09
Other Trace Elements—0.08
Aluminum—Remainder

The melt was processed to a No. 10 gauge soft wire. The physical properties of the wire were as follows:

Ultimate Tensile Strength—18,200 psi
Percent Ultimate Elongation—25.2%
Conductivity—60.10% IACS

EXAMPLE NO. 3

An additional alloy melt was prepared according to Example No. 1 so that the composition was as follows in weight percent:

Copper—0.50%
Iron—0.08
Other Trace Elements—0.13
Aluminum—Remainder

The melt was processed to a No. 10 gauge soft wire. The physical properties of the wire were as follows:

Ultimate Tensile Strength—17,400 psi
Percent Ultimate Elongation—18.5%
Conductivity—60.30% IACS

EXAMPLE NO. 4

An additional alloy melt was prepared according to Example No. 1 so that the composition was as follows in weight percent:

Copper—0.85
Iron—0.05
Other Trace Elements—0.21
Aluminum—Remainder

The melt was processed to a No. 10 gauge soft wire. The physical properties of the wire were as follows:

Ultimate Tensile Strength—21,200 psi
Percent Ultimate Elongation—16.5%
Conductivity—59.10% IACS Through testing and analysis of the alloys of this invention it has been found that the present aluminum alloys, after cold working, include the intermetallic compound percipitate $Al_2Cu$. This intermetallic compound has been found to be very stable and especially so at high temperatures. In addition it has a low tendency to coalesce during annealing of products formed from the alloy and the compound is generally incoherent with the aluminum matrix. The mechanism of strengthening for this alloy is in part due to the dispersion of the intermetallic compound as a precipitate throughout the aluminum matrix. The precipitate tends to pin dislocation sites which are created during cold working of the wire formed from the alloy. Upon examination of a cold drawn wire, it is found that the precipitates are oriented in the direction of drawing. In addition, it is found that the precipitates can be rod-like, plate-like, or spherical in configuration.

Intermetallic compounds which may be formed, depending upon the constituents of the melt and the relative concentrations of the alloying elements, include the following: $Al_7Cu_2Fe$, $NiAl_3$, $Ni_2Al_3$, MgCoAl, $Fe_2Al_5$, $FeAl_3$, $Co_2Al_9$, $Co_4Al_{13}$, $CeAl_4$, $CeAl_2$, $VAl_{11}$, $Val_7$, $VAl_6$, $VAl_3$, $VAl_{12}$, $Zr_3Al$, $Zr_2Al$, $LaAl_4$, $LaAl_2$, $Al_3Ni_2$, $Al_2Fe_5$, $Fe_3NiAl_{10}$, $Co_2Al_5$, $FeNiAl_9$.

A characteristic of high conductivity aluminum alloy wire which is not indicated by the historical tests for tensile strength, percent elongation and electrical conductivity is the possible change in properties as a result of increases, decreases or fluctuations of the temperature of the strands. It is apparent that the maximum operating temperature of a strand or series of strands will be affected by this temperature characteristic. The characteristic is also quite significant from a manufacturing viewpoint since many insulation processes require high temperature thermal cures.

It has been found that the aluminum alloy wire of the present invention has a characteristic of thermal stability which exceeds the thermal stability of conventional aluminum alloy wires.

Table III clearly shows that after being subjected to a temperature of 482° F. for four hours an electrical conductor of this invention retained in excess of ninety (90) percent of all properties tested.

TABLE III

| Thermal Stability | | | | | | | | | | |
|---|---|---|---|---|---|---|---|---|---|---|
| Fe | Ni | Zn | Mn | Cr | GA | Si | Ti | V | Mg | Cu |
| .12 | .003 | .015 | .003 | .0015 | .01 | .04 | .001 | .0035 | .001 | .45 |

| | Dia. | UTS | YTS | % Elong. | % IACS |
|---|---|---|---|---|---|
| Sample Rod | .381 | 28.6 | 22.8 | 12.1 | 59.41 |
| As Drawn | .102 | 32.2 | 29.8 | 2.8 | 58.95 |
| Annealed 3 Hrs. @ 525° F. | .102 | 17.3 | 9.9 | 16.2 | 60.80 |
| 4 Hrs. @ 482° F. | .102 | 16.6 | 9.1 | 19.8 | 61.19 |
| percent retention | | 95.9 | 91.9 | 122.2 | 100.6 |

For the purpose of clarity, the following terminology used in this application is explained as follows:

Aluminum alloy rod—A solid product that is long in relation to its cross-section. Rod normally has a cross-section of between three inches and 0.375 inches.

Aluminum alloy wire—A solid wrought product that is long in relation to its cross-section, which is square or rectangular with sharp or rounded corners or edges, or is round, a regular hexagon or a regular octagon, and whose diameter or greatest perpendicular distance between parallel faces is between 0.374 and 0.0031 inches.

While this invention has been described in detail with particular reference to preferred embodiments thereof, it will be understood that variations and modifications can be effected within the spirit and scope of the invention as described hereinbefore and as defined in the appended claims.

What is claimed is:

1. A process for preparing a heat resistant aluminum alloy conductor having an electrical conductivity of at least fifty-seven percent (57%) IACS, a percentage elongation of at least 12 percent, and a tensile strength of at least 12,000 psi and containing copper aluminate inclusions having a particle size diameter of less than 10,000 angstrom units when measured along the transverse axis of said inclusions, comprising the steps of:

(a) alloying from about 0.10 to about 1.00 weight percent copper and from about 99.00 to about 99.90 weight percent aluminum; said aluminum consisting essentially of no more than about 0.10 weight percent each of trace elements selected from the group consisting of vanadium, iron, silicon, manganese, magnesium, zinc, boron and titanium with the total concentration of said trace elements not exceeding about 0.30 weight percent;

(b) casting the alloy into a continous bar in a moving mold formed by a groove in the periphery of a casting wheel and an endless belt lying adjacent to the groove along a portion of the periphery of the wheel;

(c) hot-working the bar substantially immediately after casting while the bar is in substantially that condition as cast by rolling the bar in closed roll passes to obtain a continuous aluminum alloy rod;

(d) drawing the rod with no intermediate anneals to form wire containing the intermetalic precipitate $Al_2Cu$; and (e) annealing or partially annealing the wire.

2. The process of claim 1 wherein step (e) comprises batch annealing said wire for a time of from about thirty minutes to about 24 hours at a temperature of from about 400° F. to about 750° F.

3. A heat resistant aluminum alloy electrical conductor produced by the process of claim 1 and further characterized by having an electrical conductivity of at least fifty-seven percent (57%) IACS, a percentage elongation of at least 12 percent, and a tensile strength of at least 12,000 psi when annealed for three hours at a temperature of 650° F. consisting essentially of from about 0.10 to about 1.00 weight percent copper and from about 99.00 to about 99.90 weight percent aluminum with said trace elements.

4. The aluminum alloy electrical conductor of claim 3 consisting essentially of from about 0.10 to about 0.30 weight percent copper and from about 99.70 to about 99.30 weight percent aluminum.

5. The aluminum alloy electrical conductor of claim 3 consisting essentially of from about 0.30 to about 0.45 weight percent copper and from about 99.55 to about 99.70 weight percent aluminum.

6. The aluminum alloy electrical conductor of claim 3 consisting essentially of from about 0.45 to about 0.85 weight percent copper and from about 99.15 to about 99.55 weight percent aluminum.

7. The aluminum alloy electrical conductor of claim 3 consisting essentially of from about 0.85 to about 1.00 weight percent copper and from about 99.15 to about 99.00 weight percent aluminum.

* * * * *